US010357696B2

(12) United States Patent
Doi et al.

(10) Patent No.: US 10,357,696 B2
(45) Date of Patent: Jul. 23, 2019

(54) GOLF CLUB HEAD AND GOLF CLUB

(71) Applicant: MIZUNO CORPORATION, Osaka (JP)

(72) Inventors: Kazuhiro Doi, Osaka (JP); Arata Kamo, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 15/580,342

(22) PCT Filed: Jun. 6, 2016

(86) PCT No.: PCT/JP2016/066758
§ 371 (c)(1),
(2) Date: Dec. 7, 2017

(87) PCT Pub. No.: WO2016/199719
PCT Pub. Date: Dec. 15, 2016

(65) Prior Publication Data

US 2018/0185716 A1 Jul. 5, 2018

(30) Foreign Application Priority Data

Jun. 8, 2015 (JP) ..... 2015-115497

(51) Int. Cl.
*A63B 53/04* (2015.01)

(52) U.S. Cl.
CPC .... *A63B 53/047* (2013.01); *A63B 2053/0429* (2013.01); *A63B 2053/0454* (2013.01)

(58) Field of Classification Search
USPC ..... 473/324–350
See application file for complete search history.

(56) References Cited

U.S. PATENT DOCUMENTS 4,848,747 A 7/1989 Fujimura et al.
5,016,882 A 5/1991 Fujimura et al.
(Continued)

FOREIGN PATENT DOCUMENTS

EP 1693087 A1 8/2006
EP 2548622 A1 1/2013
(Continued)

OTHER PUBLICATIONS

International Search Report and Written Opinion of the International Searching Authority for related International Patent Application No. PCT/JP2016/066758 dated Aug. 30, 2016.
(Continued)

*Primary Examiner* — Alvin A Hunter
(74) *Attorney, Agent, or Firm* — Troutman Sanders LLP; Daniel T. Sharpe

(57) ABSTRACT

Provided are a golf club head and a golf club with a plate member that is resistant to peeling and has a glossy appearance. A golf club head includes a face portion including a ball striking surface, and a plate member connected to a back surface located on the back side of the face portion. The plate member includes a resin and a metal material. The metal material is arranged on at least any one of a toe side and a heel side of the face portion and is arranged so as not to planarly overlap a striking point of the face portion.

4 Claims, 4 Drawing Sheets

(56) References Cited

U.S. PATENT DOCUMENTS

| | | | | | |
|---|---|---|---|---|---|
| 5,316,298 | A * | 5/1994 | Hutin | A63B 53/04 | 473/332 |
| 5,586,947 | A * | 12/1996 | Hutin | A63B 53/04 | 473/324 |
| 5,649,872 | A * | 7/1997 | Antonious | A63B 53/04 | 473/332 |
| 5,697,855 | A * | 12/1997 | Aizawa | A63B 53/04 | 473/350 |
| 6,719,641 | B2 * | 4/2004 | Dabbs | A63B 53/04 | 473/291 |
| 7,303,489 | B2 * | 12/2007 | Gilbert | A63B 53/0475 | 473/345 |
| 7,384,348 | B2 * | 6/2008 | Lin | A63B 53/04 | 473/332 |
| 7,387,579 | B2 * | 6/2008 | Lin | A63B 53/04 | 473/332 |
| 7,662,050 | B2 * | 2/2010 | Gilbert | A63B 53/047 | 473/332 |
| 7,789,771 | B2 * | 9/2010 | Park | A63B 53/0475 | 473/332 |
| 7,803,068 | B2 * | 9/2010 | Clausen | A63B 53/04 | 473/350 |
| 8,267,807 | B2 * | 9/2012 | Takechi | A63B 53/0475 | 473/332 |
| 8,333,667 | B2 * | 12/2012 | Kumamoto | A63B 53/04 | 473/342 |
| 8,506,423 | B2 * | 8/2013 | Oldknow | A63B 53/047 | 473/346 |
| 8,864,603 | B2 * | 10/2014 | Kumamoto | A63B 53/047 | 473/332 |
| 9,039,543 | B2 * | 5/2015 | Mizutani | A63B 53/047 | 473/332 |
| 2011/0021283 | A1 | 1/2011 | Hatton et al. | | |
| 2012/0172144 | A1 | 7/2012 | Mazutani | | |

FOREIGN PATENT DOCUMENTS

| | | | | |
|---|---|---|---|---|
| JP | 63-68371 | | | 5/1988 |
| JP | 09-322952 | A | | 12/1997 |
| JP | 2000073028 | A | * | 3/2000 |
| JP | 2005-137634 | A | | 6/2005 |
| JP | 2008125811 | A | * | 6/2008 |
| JP | 2012-139404 | A | | 7/2012 |
| WO | 9400015677 | | | 7/1994 |

OTHER PUBLICATIONS

English Translation of the International Search Report for related International Patent Application No. PCT/JP2016/066758 dated Aug. 30, 2016.

European Search Report issued in co-pending European Patent Application 16807426.8 dated Jan. 29, 2019.

* cited by examiner

GOLF CLUB HEAD AND GOLF CLUB

CROSS REFERENCE TO RELATED PATENT APPLICATIONS

This application is a U.S. National Stage of International Patent Application No. PCT/JP2016/066758, filed Jun. 6, 2016, which claims benefit of priority to Japanese Patent Application No. 2015-115497, filed Jun. 8, 2015. The entire contents of these applications are hereby incorporated by reference.

TECHNICAL FIELD

The present invention relates to golf club heads and golf clubs, and particularly, to a golf club head and a golf club that have a high coefficient of restitution.

BACKGROUND ART

For golf club heads, reducing the thickness of a face portion having a ball striking surface has been a conventional pursuit (for example, reducing the thickness to 3.0 mm or less). A thinned face portion allows the face portion to flex with ease when a ball is struck. This leads to an effect of improving the coefficient of restitution, which in turn increases the travel distance of the ball.

The thinned face portion, however, commonly tends to make a loud sound when the ball is struck, which is resistant to attenuation. Such a tendency may adversely affect the feeling achieved by a golfer when striking a ball. As a way to attenuate such a sound, thus, a resin plate is provided on the back side of the face portion in a known technique.

Japanese Patent Laying-Open No. 2005-137634 describes a golf club head and a golf club in which a resin plate having a predetermined thickness is attached to a back surface of a ball striking portion of a face portion having a predetermined thickness. Japanese Patent Laying-Open No. 2005-137634 also describes that the provision of a groove portion in the resin plate allows the resin plate to easily follow the flexion of the face portion when a ball is struck, preventing or reducing peeling of the resin plate after repeated striking of the ball.

CITATION LIST

Patent Document

PTD 1: Japanese Patent Laying-Open No. 2005-137634

SUMMARY OF INVENTION

Technical Problem

Recently, there has been a demand for providing a resin plate with a glossy appearance so that it has an improved appearance. To meet such a demand, the use of a metal plate in place of a resin plate is conceivable. The metal plate, however, has high hardness and is resistant to flexion compared with the resin plate. The use of a metal plate in place of a resin plate can thus cause the metal plate to break or the plate to peel off from a golf club head.

The present invention has been made to solve the above problem and has an object to provide a golf club head and a golf club including a plate member that is resistant to peeling and has a glossy appearance.

Solution to Problem

A golf club head according to the present embodiment includes a face portion including a ball striking surface, and a plate member connected to a back surface positioned on a back side of the face portion. The plate member includes a resin and a metal material. The metal material is arranged on at least any one of a toe side and a heel side of the face portion and is arranged so as not to planarly overlap a striking point of the face portion.

Advantageous Effects of Invention

In the present invention, a resin is used, and a metal material is arranged so as not to planarly overlap a striking point. This prevents or reduces peeling of the plate member from the face portion and also provides the plate member with a glossy appearance owing to the metal material arranged on at least any one of the toe side and the heel side of the plate member. Therefore, the strength and gloss appearance of the plate member can be compatible with each other.

DESCRIPTION OF EMBODIMENTS

An embodiment of the present invention will now be described with reference to the drawings.

Figure 1:
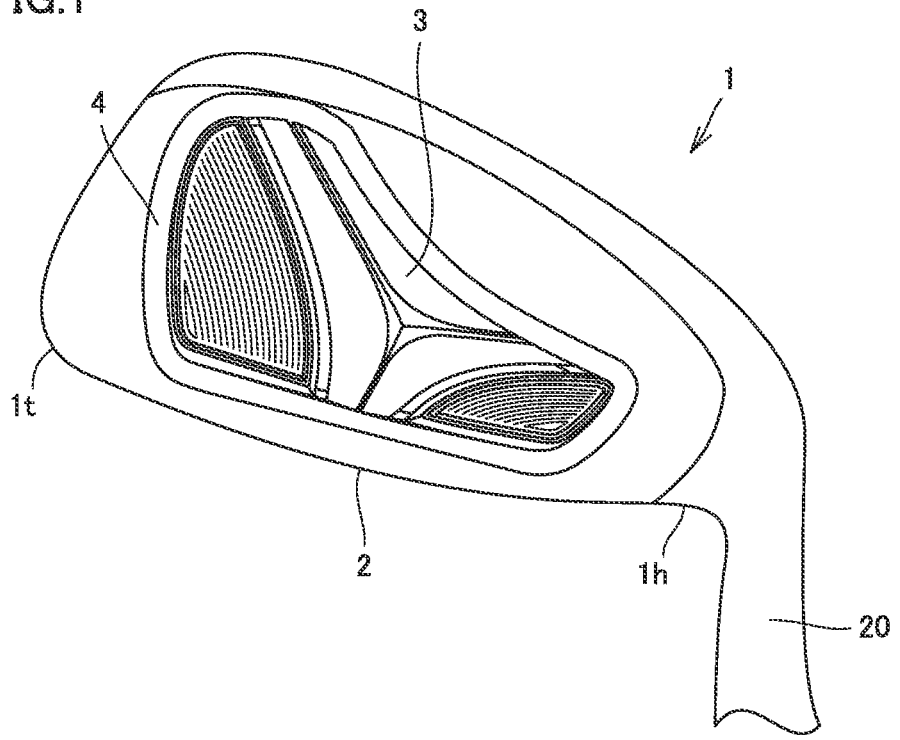
FIG. 1 is a schematic diagram of a golf club according to an embodiment, particularly focusing on a plate member of a golf club head.

Referring to FIG. 1, a golf club head 1 according to the present embodiment is fixed at a tip of a shaft 20 and forms a golf club. Golf club head 1 includes a face portion 2 and a plate member 3, which is located on a back side of face portion 2 and is connected to face portion 2.

Face portion 2 includes a ball striking surface. The ball striking surface is mainly expected to strike a ball and, at its central portion and therearound, has a region (so-called sweet spot) having a high coefficient of restitution (COR). The coefficient of restitution of the ball striking surface at the sweet spot is 0.846 or more and 0.8476 or less, which is closer to a rule upper limit of the coefficient of restitution (0.8487) at an impact velocity of, for example, 40.5 m/s.

The coefficient of restitution of golf club head 1 is calculated by, for example, the following method. Specifically, a golf ball (mass: m) is forced to impact a stationary golf club head (mass: M), an incoming velocity (a velocity of the ball before impacting the face surface) $V_{IN}$ and an outgoing velocity (a velocity of the ball after impacting the face surface) $V_{OUT}$ of the ball are measured, and then, the coefficient of restitution is calculated from Expression (1) below.

$$V_{OUT}/V_{IN}=(eM-m)/(M+m) \quad (1)$$

Used as a golf ball is, for example, Pinnacle GOLD LS available from Acushnet Company that has been stored indoors at approximately 23° C., and an impact velocity is, for example, 40.5 m/s. To enable the golf ball to bounce off the front of the face surface when it is forced to impact the face surface, the club head is fixed to allow the ball to impact the face surface from the direction normal to the face surface. The coefficient of restitution is calculated by repeating measurements seven times, and then, obtaining an average of five measurement values excluding the greatest and smallest values.

Face portion 2 and a face back surface located on the back side thereof to be opposed thereto extend parallel to the ball striking surface in the approximately horizontal direction of FIG. 1 from a heel portion 1*h* side (heel side) to a toe portion 1*t* side (toe side).

A cavity 4 is formed in the face back surface. In cavity 4, plate member 3 is connected to the back side of face portion 2.

Figure 2:
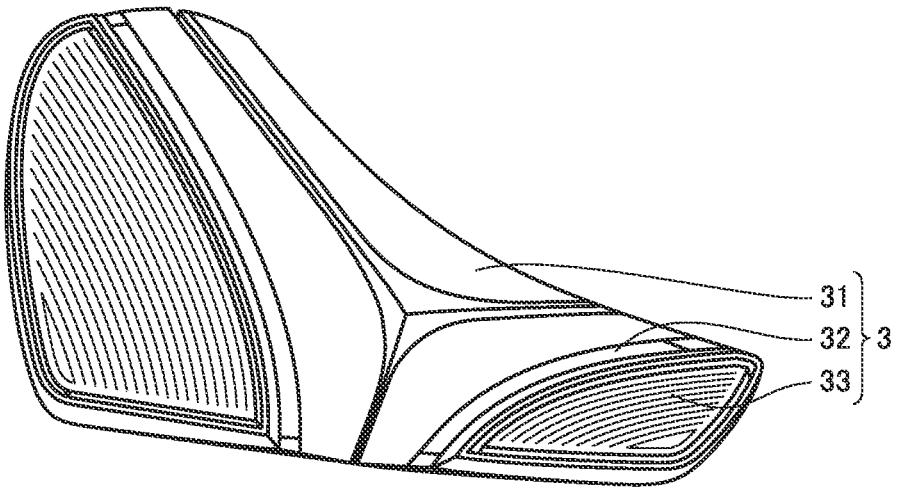
FIG. 2 is a schematic diagram of the plate member illustrated in FIG. 1.
Figure 3:
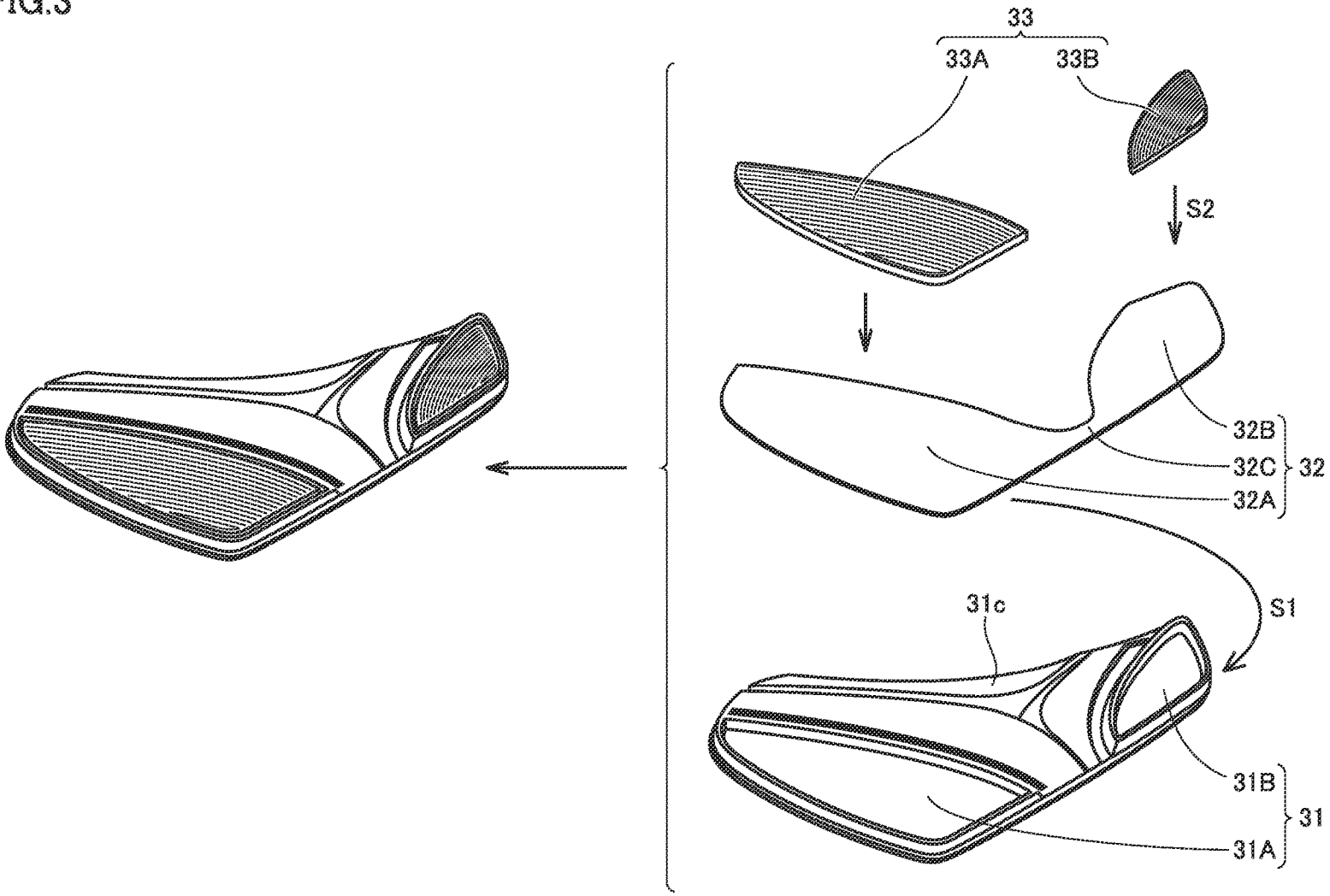
FIG. 3 is a schematic diagram illustrating small members of the plate member of FIG. 2, the configuration of these members, and how to assemble these members.

Referring to FIGS. 2 and 3, plate member 3 includes a resin plate 31, a metal part 32, and an attachment part 33.

Resin plate 31 is a member serving as a base of the entire plate member 3 and has a planar shape similar to that of the entire plate member 3 illustrated in FIG. 2. Resin plate 31 is made of, for example, thermoplastic polyurethane (TPU), that is, a urethane resin such as thermoplastic polyurethane. Alternatively, resin plate 31 may be made of PC, namely, polycarbonate, or ABC resin (synthetic resin of acrylonitrile, butadiene, and styrene), in place of TPU.

A groove portion is formed in the surface of resin plate 31. This groove portion divides resin plate 31 into a first resin portion 31A, a second resin portion 31B, and a third resin portion 31C. This allows resin plate 31 to easily follow the flexion of face portion 2 when a ball is struck. Plate member 3 including resin plate 31 is accordingly resistant to a defect such as peeling off from face portion 2.

Metal part 32 is a member made of a metal material that is relatively lightweight and soft, that is, relatively easily flexes, such as aluminum. Metal part 32 is divided into a first metal portion 32A, a second metal portion 32B, and a third metal portion 32C. Metal part 32 is arranged such that at least part thereof, that is, upper and lower parts thereof in its thickness direction are nipped by resin plate 31. In other words, metal part 32 is arranged such that at least part thereof is buried in resin plate 31 in the thickness direction of resin plate 31. As a result, first metal portion 32A is arranged to include a region that overlaps first resin portion 31A in a plan view, second metal portion 32B is arranged to include a region that overlaps second resin portion 31B in a plan view, and third metal portion 32C is arranged to include a region that overlaps third resin portion 31C in a plan view. Herein, the plan view means the state in which golf club head 1 is viewed from directly above, that is, from the back surface 3 side while golf club head 1 is placed such that face portion 2 is on the lower side and is parallel to the ground.

For example, metal part 32 made of, for example, aluminum is put into a mold for forming resin plate 31. Subsequently, the space between metal part 32 and the mold is filled with a urethane resin material such as TPU to integrally mold resin plate 31 and metal part 32. S1 in FIG. 3 indicates the integrally molding step.

First metal portion 32A and second metal portion 32B are arranged to be exposed from resin plate 31 at least partially, specifically, in the regions located in front of first metal portion 32A and second metal portion 32B in FIG. 3.

Third metal portion 32C is a region that connects first metal portion 32A and second metal portion 32B in the region therebetween. This region causes first metal portion 32A, second metal portion 32B, and third metal portion 32C to be united.

Referring to FIGS. 1 and 3, first resin portion 31A and second resin portion 31B of resin plate 31 are arranged on the toe portion 1*t* side and the heel portion 1*h* side, respectively. Thus, first metal portion 32A and second metal portion 32B of metal part 32 are arranged on the toe portion 1*t* side and the heel portion 1*h* side, respectively. As described above, metal part 32 is arranged on both the toe portion 1*t* side and the heel portion 1*h* side of face portion 2. However, it suffices that metal part 32 is arranged at any one of the toe portion 1*t* side and the heel portion 1*h* side of face portion 2, and for example, any one of first metal portion 32A and second metal portion 32B alone may be arranged. First metal portion 32A and second metal portion 32B do not necessarily have to be integrally connected by third metal portion 32C. For example, in one configuration, first metal portion 32A and second metal portion 32B may be arranged individually, and third metal portion 32C may not be arranged.

Referring again to FIGS. 2 and 3, attachment part 33 includes a first attachment part 33A and a second attachment part 33B as separate members. Attachment part 33 is a sheet member formed by, for example, electroforming.

First attachment part 33A is bonded onto a surface of a region of first metal portion 32A that is exposed from first resin portion 31A with, for example, an adhesive (not shown) or a double-sided tape (not shown). Similarly, second attachment part 33B is bonded onto a surface of a region of second metal portion 32B that is exposed from second resin portion 31B with, for example, an adhesive (not shown) or a double-sided tape (not shown). S2 in FIG. 3 indicates this bonding step.

Figure 4:
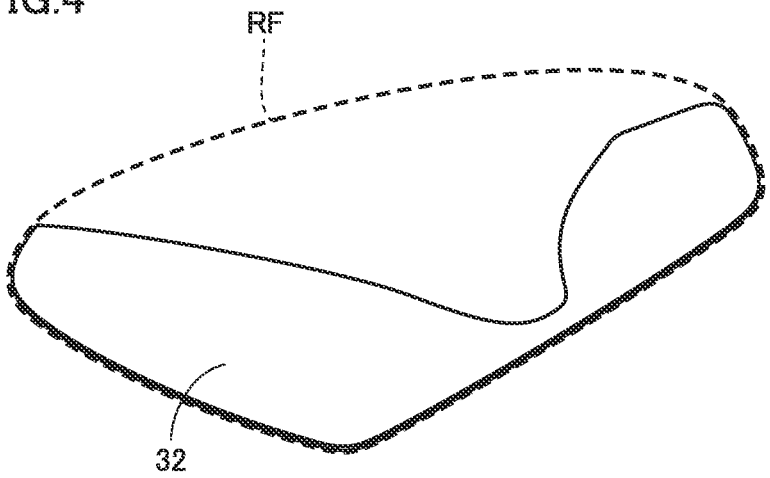
FIG. 4 is a schematic diagram illustrating a metal part of the embodiment and a metal part of a comparative example overlapped thereon.

Referring to FIG. 4, a reference metal part RF, which is a metal part as a comparative example of the present embodiment, has a plane area larger than that of metal part 32 so as to include metal part 32 of the present embodiment. In other words, in a plan view of reference metal part RF seen from directly above, for example, reference metal part RF has an area substantially equal to or smaller than that of resin plate 31.

Figure 5:
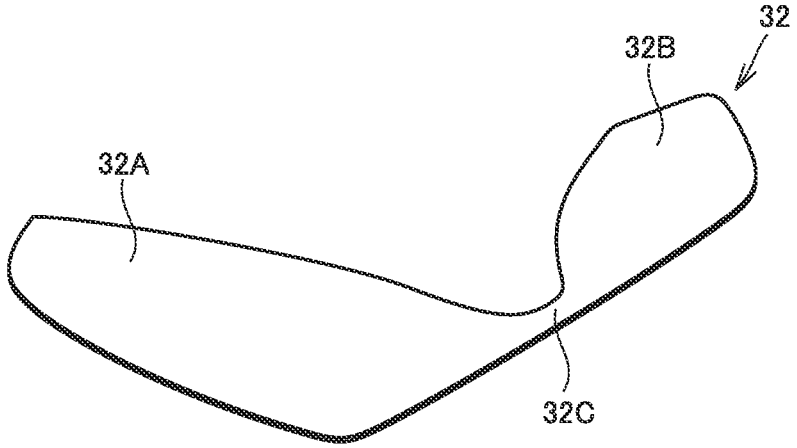
FIG. 5 is a schematic diagram illustrating the metal part of the embodiment alone, which is taken out of the state of FIG. 4.

Referring to FIG. 5, in a plan view of metal part 32 of the present embodiment seen from directly above, metal part 32 has a folding-fan shape in which first metal portion 32A and second metal portion 32B extend from third metal portion 32C in opposite directions. From a different viewpoint, metal part 32 includes first metal portion 32A (toe-side portion) located on the toe portion 1*t* side of face portion 2, second metal portion 32B (heel-side portion) located on the heel portion 1*h* side of face portion 2, and third metal portion 32C (connection) connecting first metal portion 32A and second metal portion 32B. The distance between outer perimeters of regions of first metal portion 32A and second metal portion 32B that are opposed to each other increases as apart from third metal portion 32C.

Figure 6:
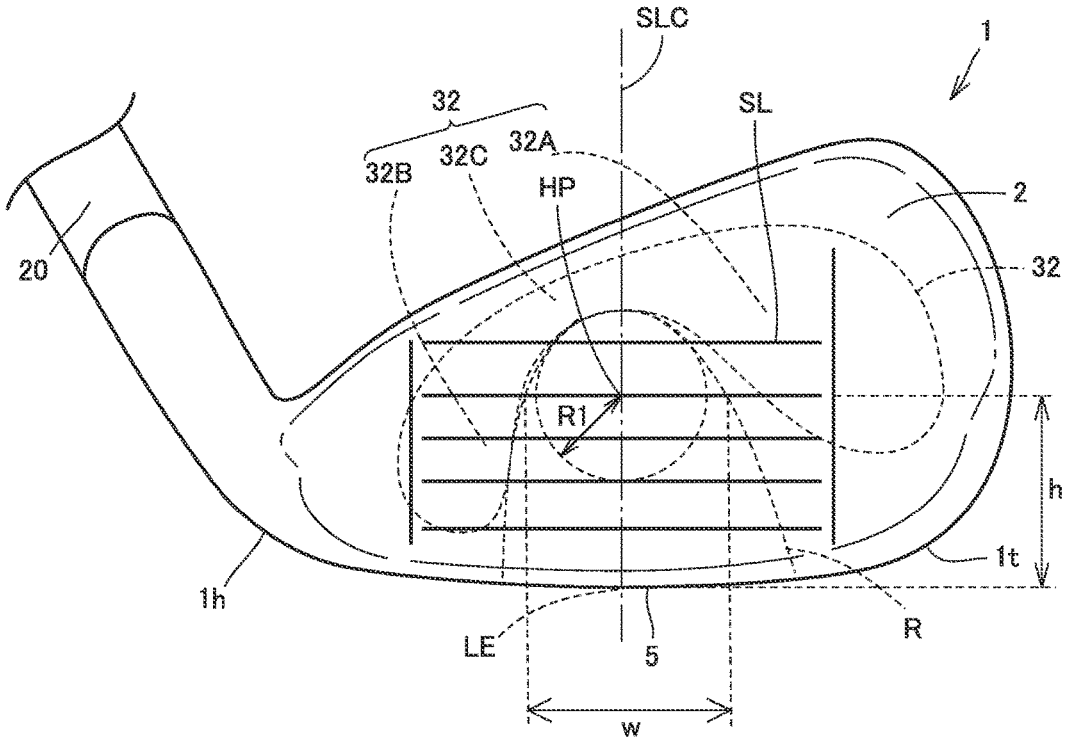
FIG. 6 is a schematic diagram for explaining a region in which a metal part is not arranged in a plan view of a face portion.

Referring to FIG. 6, golf club head 1 includes a sole portion 5, which is a portion directed to the ground when a ball is struck. A plurality of score lines SL are provided on the ball striking surface of face portion 2. The plurality of score lines SL are formed substantially parallel to each other so as to extend along the direction connecting toe portion 1*t* and heel portion 1*h* (the horizontal direction in FIG. 6). A score line center SLC, which connects the respective midpoints of the plurality of score lines SL in the direction connecting toe portion 1*t* and heel portion 1*h*, extends perpendicular to score lines SL. An intersection between sole portion 5 and score line center SLC corresponds to an edge of face portion 2 that is located on the sole portion 5 side, which is indicated by a leading edge LE in FIG. 6.

At this time, metal part 32 is arranged in a region except for a range having a radius R1 of 11.5 mm or less from a point planarly overlapping a striking point HP of face portion 2. Herein, striking point HP is a point with a height h of 15 mm from leading edge LE on score line center SLC. In other words, metal part 32 is arranged in the region outside a circle indicated by a dotted line in FIG. 6. As indicated by the dotted line in FIG. 6, metal part 32 is arranged so as not to enter the circle indicated by the dotted line, particularly above striking point HP. In the region below striking point HP, plate member 3 is not arranged in the first place, as indicated by the dotted line in FIG. 6.

A large number of regions in which metal part 32 is not arranged are also present outside the circle indicated by the dotted line in FIG. 6, particularly in the regions located to the lower left and the lower right of the circle. In other words, in addition to the region having a radius R1 of 11.5 mm or less from striking point HP, a large number of regions in which metal part 32 is not arranged are present.

Specifically, the region in which metal part 32 is not arranged is within the range in which a width w in the horizontal direction in FIG. 6, including score line center SLC, is 23 mm or less, at the position with a height h of 20 mm along score line center SLC from leading edge LE on the face surface. In addition, at the positions with heights h of 25 mm, 30 mm, and 35 mm, the region is within the ranges in which width w is 14 mm or less, 9 mm or less, and 3 mm or less, respectively. A region R defined by connecting these ranges is a range in which metal part 32 is not arranged. It is preferable that when considering width w, consideration be made to arrange score line center SLC at the center of width w in the width direction. In other words, it can be said that at a position with a height h of 20 mm, the regions with a width of 11.5 mm or less that are located to the left and right of the core line center SLC, being the center, are regions in which metal part 32 is not arranged. Consequently, the entire region of the circle with a radius R1 of 11.5 mm or less from striking point HP is included in region R.

The region in which metal part 32 is not arranged widens as closer to the lower side (sole portion 5) of golf club head 1. As a result, metal part 32 including first metal portion 32A and second metal portion 32B running in the opposite directions from third metal portion 32C and having a folding-fan shape is arranged so as to avoid the above-mentioned region.

More specifically, for example, first metal portion 32A of metal part 32 is arranged to overlap the region located to the right of the region in which metal part 32 is not arranged. For example, second metal portion 32B of metal part 32 is arranged to overlap the region located to the left of the region in which metal part 32 is not arranged. For example, second metal portion 32B of metal part 32 is arranged to overlap the region above the region in which metal part 32 is not arranged. Third metal portion 32C serving as a connection is located on the top side (the side opposite to sole portion 5, i.e., upper side) of face portion 2.

The operation and effect of the present invention will now be described

When a member including an epoxy resin and a metal thin wall formed thereon by electroforming is used as the plate member, the epoxy resin filling the inside of the metal thin wall may crack or the plate member may peel off when a golf club head including this member strikes a ball. This is because the epoxy resin, which has relatively high hardness, is unlikely to follow the flexion of the face portion when a ball is struck.

However, a defect such as peeling will not occur through the use of a urethane resin, such as TPU, as the plate member in place of the epoxy resin. This is because the urethane resin, which has low hardness, is likely to follow the flexion of the face portion (i.e, is highly likely to flex) when a ball is struck.

Although it is conceivable from this viewpoint that the plate member may be preferably formed from a urethane resin alone, the plate member is preferably provided with a glossy appearance from the viewpoint of an improved appearance of a user's golf club head. The configuration including a metal part made of, for example, aluminum is thus preferred.

The present embodiment provides a configuration in which plate member 3 includes urethane resin plate 31, metal part 32 made of aluminum or the like, and attachment part 33. Such a configuration enables resin plate 31 to flex more easily when a ball is struck and also enables metal part 32 and attachment part 33 to have a glossier appearance.

For example, urethane resin plate 31 has high surface energy, which makes it difficult to bond attachment part 33 directly onto the surface of urethane resin plate 31. Contrastingly, in the present embodiment, the presence of metal part 32 exposed from resin plate 31 enables attachment part 33 to be firmly bonded to the surface of metal part 32.

Metal part 32 is arranged on at least any one of the toe portion 1*t* side and the heel portion 1*h* side of face portion 2 and is also arranged so as not to planarly overlap striking point HP of face portion 2. More specifically, metal part 32 is arranged in a region except for a region having a radius of 11.5 mm or less around a point planarly overlapping the striking point of face portion 2. This allows metal part 32 to be arranged in a region except for the region overlapping the central portion of face portion 2 in a plan view of metal part 32 viewed from directly above so as to avoid such a region. Consequently, metal part 32 is not arranged in the portion that experiences an impulsive force of a ball when the ball is struck, preventing or reducing damage to metal part 32 when the ball is struck. Plate member 3 in the region overlapping the central portion of face portion 2 is resin plate 31 alone that flexes with ease, and thus, excellent flexibility of resin plate 31 prevents or reduces peeling of resin plate 31.

Metal part 32 has a folding-fan shape toward sole portion 5, and more specifically, the distance between outer perimeters of regions of first metal portion 32A and second metal portion 32B that are opposed to each other increases as apart from third metal portion 32C. This provides golf club head 1 with a glossy appearance so that it has an improved appearance at the relevant portion and also enables attachment part 33 to be bonded to metal part 32 exposed at the relevant portion.

First metal portion 32A on the toe portion 1*t* side and second metal portion 32B on the heel portion 1*h* side are connected to each other with third metal portion 32C therebetween. This structure allows metal part 32 to be manufactured in a simple manner. In addition, third metal portion

32C arranged on the top side of face portion 2 ensures that third metal portion 32C is arranged so as not to planarly overlap striking point HP.

Although the present invention has been described and illustrated in detail, it is clearly understood that the same is by way of illustration and example only and is not to be taken by way of limitation, the scope of the present invention being interpreted by the terms of the appended claims.

INDUSTRIAL APPLICABILITY

The present invention is particularly advantageously applied to a golf club head and a golf club that have a high coefficient of restitution.

REFERENCE SIGNS LIST

1: golf club head; 1*h*: heel portion; 1*t*: toe portion; 2: face portion; 3: plate member; 4: cavity; 20: shaft; 31: resin plate; 31A: first resin portion; 31B: second resin portion; 31C: third resin portion; 32: metal part; 32A: first metal portion; 32B: second metal portion; 32C: third metal portion; 33: attachment part; 33A: first attachment part; 33B; second attachment part; HP: striking point; LE: leading edge; RF: reference metal part; SL: score line; SLC: score line center.

The invention claimed is:

1. A golf club head comprising:

a face portion including a ball striking surface; and a plate member connected to a back surface located on a back side of the face portion, the plate member including a resin and a metal material, the metal material being arranged on at least any one of a toe side and a heel side of the face portion and being arranged so as not to planarly overlap a striking point of the face portion;

wherein the metal material is arranged in a region except for a region having a radius of 11.5 mm or less around a point planarly overlapping the striking point of the face portion.

2. The golf club head according to claim 1, wherein the metal material includes a toe-side portion located on the toe side of the face portion, a heel-side portion located on the heel side of the face portion, and a connection connecting the toe-side portion and the heel-side portion, and a distance between outer perimeters of regions in the toe-side portion and the heel-side portion that are opposed to each other increases as apart from the connection.

3. The golf club head according to claim 2, wherein the connection is located on a top side of the face portion.

4. A golf club comprising:

a shaft; and a golf club head comprising:

a face portion including a ball striking surface;

a plate member connected to a back surface located on a back side of the face portion;

the plate member including a resin and a metal material;

the metal material being arranged on at least any one of a toe side and a heel side of the face portion and being arranged so as not to planarly overlap a striking point of the face portion; and wherein the metal material is arranged in a region except for a region having a radius of 11.5 mm or less around a point planarly overlapping the striking point of the face portion.

* * * * *